US006932006B1

(12) United States Patent
Morkovsky

(10) Patent No.: US 6,932,006 B1
(45) Date of Patent: Aug. 23, 2005

(54) ANCHORING AND DESIGN PLACEMENT DEVICE FOR HOME EMBROIDERY MACHINES

(76) Inventor: Henry Morkovsky, 909 Wood St., Rockport, TX (US) 78382

( * ) Notice: Subject to any disclaimer, the term of this patent is extended or adjusted under 35 U.S.C. 154(b) by 0 days.

(21) Appl. No.: 10/829,691

(22) Filed: Apr. 21, 2004

(51) Int. Cl.[7] ..... D05C 9/04
(52) U.S. Cl. ..... 112/103; 38/102.2
(58) Field of Search ..... 112/103, 119, 470.14, 112/475.11; 38/102.2, 102.91; 33/1 AA, 33/11; 269/289 R; 101/127.1

(56) References Cited

U.S. PATENT DOCUMENTS 4,545,127 A * 10/1985 Barry ..... 33/613
4,561,177 A * 12/1985 Rancer ..... 29/721
4,767,111 A * 8/1988 Guenther ..... 269/303
4,774,778 A * 10/1988 Williams ..... 38/102.2
5,144,899 A * 9/1992 Allen ..... 112/103
5,433,158 A * 7/1995 Moore, III ..... 112/103
5,555,828 A * 9/1996 Rowley ..... 112/103
5,590,613 A * 1/1997 Head ..... 112/103
5,598,797 A * 2/1997 Patterson ..... 112/103
5,664,350 A * 9/1997 Moore, III ..... 38/102.2
5,934,210 A * 8/1999 Lucchese ..... 112/103
6,116,174 A * 9/2000 Melton ..... 112/103
6,775,934 B1 * 8/2004 Gallik et al. ..... 38/102.2

* cited by examiner

*Primary Examiner*—Ismael Izaguirre

(57) ABSTRACT

A device for fixing the position of home embroidery machine hoops to facilitate placement of a design on the fabric or garment to be embroidered.

2 Claims, 2 Drawing Sheets

ANCHORING AND DESIGN PLACEMENT DEVICE FOR HOME EMBROIDERY MACHINES

BACKGROUND OF THE INVENTION

Embroidery machines use hoops to hold fabric or a garment while the machine design is sewn out. The placement of the design is of utmost importance, but the back, or female, part of the hoop is not visible while the design is being positioned. Therefore, it is always necessary to check and usually necessary to move and rotate the design in the machine after hooping. Some machines provide for incremental movement and rotation and some do not. In either case, however, placing a design in a particular place or at a particular angle in relation to a particular seam or another design that has already been embroidered is a daunting task for the home embroiderer.

Hoops are made as small and light as possible because they and the fabrics or garments must be manipulated by the machine's computer-driven mechanism. Consequently, when fabric or a garment covers a hoop it tends to be dragged about by the friction between it and the fabric unless restrained in some fashion.

Hoop-holding devices abound, primarily designed for commercial or heavy-duty hobby use. Some commercial devices define the position of inner and outer hoops by indexing them with a rigid column such as on a drill press, but they do not define the center of the hoop and they are fixed, large machines. The most common goal of other hoop-holding devices is to fit as many and as varied hoops as possible and to facilitate repetitive placement of the same design. This causes such devices to have a number of removable parts and somewhat complex operation, as well as higher cost. For the person who does occasional home embroidery large, complex, or freestanding machines or loose pegs, cams, screws are not desirable. Such a person seldom needs to position the same design in the same place over and over, and in fact may never position the same design twice, but the need is there to hold the hoop in place so it doesn't move around while the fabric or garment is positioned. Additionally, accurate placement of the design is now dependent on guesswork and further "steering" of the hooped design in the machine. Lastly, because the hardware and software of different brands of machines are rarely interchangeable, home embroiderers tend to own only a single brand of machine, thereby obviating the need for multi-brand-capable devices.

Some existing devices feature an inclined board or raised table, so that a garment can surround the hoop holding device. While this is advantageous, particularly with a heavy garment, it is illusory for the home embroiderer because the garment cannot enter the machine in this configuration but must present only the back face of the surface to receive the design. Consequently, this feature is an unneeded complexity.

SUMMARY OF INVENTION

Home embroidery machines typically hold hoops by a bracket that is an integral part of the female half of the hoop. The bracket is typically slid or clipped into the driver mechanism of the machine. If the machine is capable of using several sizes of hoops, the bracket communicates to the machine what size of hoop is installed.

The anchoring part of this invention mimics the design of the bracket irrespective of the size-communicating feature and temporarily anchors a home embroidery hoop while fabric or a garment is being positioned. The machine orients itself so as to begin each design in the same place, the center of the hoop, unless the operator moves it. The anchoring device places the center of any size hoop for the same machine in exactly the same place, which is directly under the crosshairs in the arm when the arm is lowered to touch the fabric. The arm is hinged at some distance above the base to provide clearance for excess fabric and friction is provided to support the arm in any position.

Although the anchoring device may be independently fastened to any flat surface by any means such as double-faced tape or screws, in the instance of this invention it is permanently fastened to the base. Since the device holds the hoop in the same manner as the machine itself, one anchoring device serves the entire range of hoop sizes for a given machine without the need for separate pieces or parts.

The base and arm of this device are universal; therefore, it can be made to fit virtually any brand or model of machine by merely incorporating the appropriately configured anchoring device. Some typical configurations are shown FIGS. 1 and 2, but these examples do not represent all possible configurations designed by the inventor.

DESCRIPTION OF THE PREFERRED EMBODIMENTS

Figure 1:
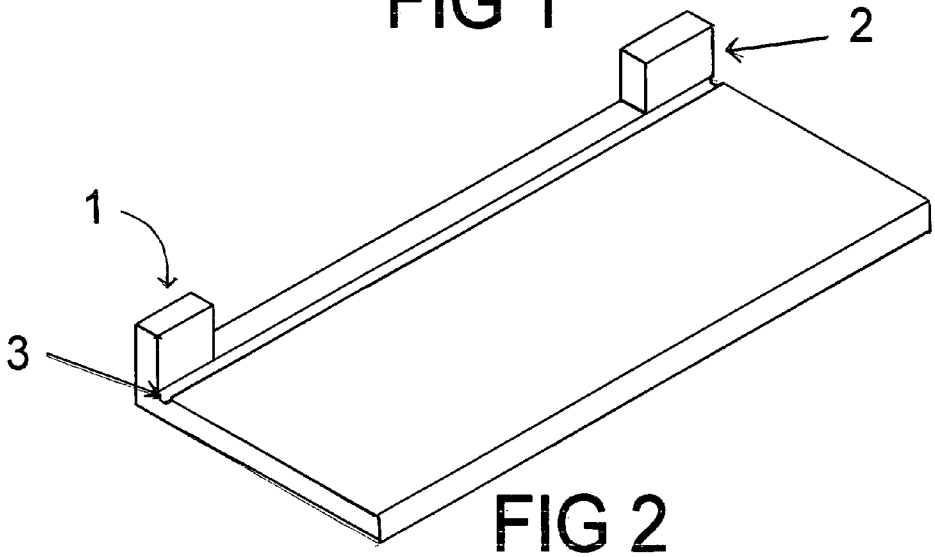
FIG. 1 shows a typical anchoring device. The groove and projections mimic some features of the machine's hoop holding/driving mechanism and some features common to the hoop families themselves.

In FIG. 1, the size, shape, and location of projections 1 and 2 cause the device to fit the lightening holes of a family of hoops common to two brands of machine. This same family includes one hoop that does not share identical lightening holes, but groove 3 and the length of this device enable it to work with at least two brands of machine and every hoop that fits those machines.

Figure 2:
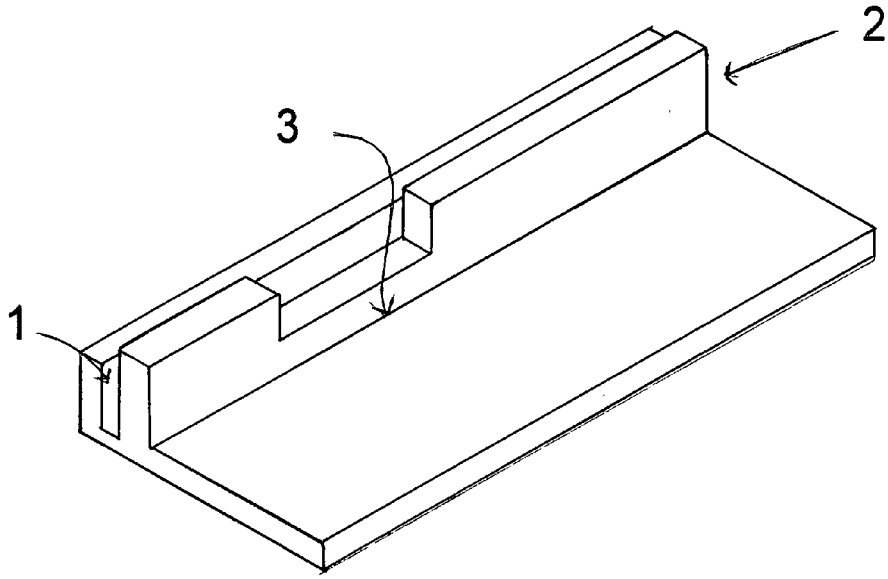
FIG. 2 shows another typical anchoring device. The groove and projections mimic some features of the machine's hoop holding/driving mechanism and some features common to the hoop families themselves.

In FIG. 2, the length of the base causes the device to fit one model of machine and the size of and distance between projections 1 and 2 causes the device to fit half the family of hoops for two machines of the same brand. The size and placement of cutout 3 in projection 2 makes this same device fit the other half of this brand's family of hoops and all the hoops for a second brand of machines.

Figure 3:
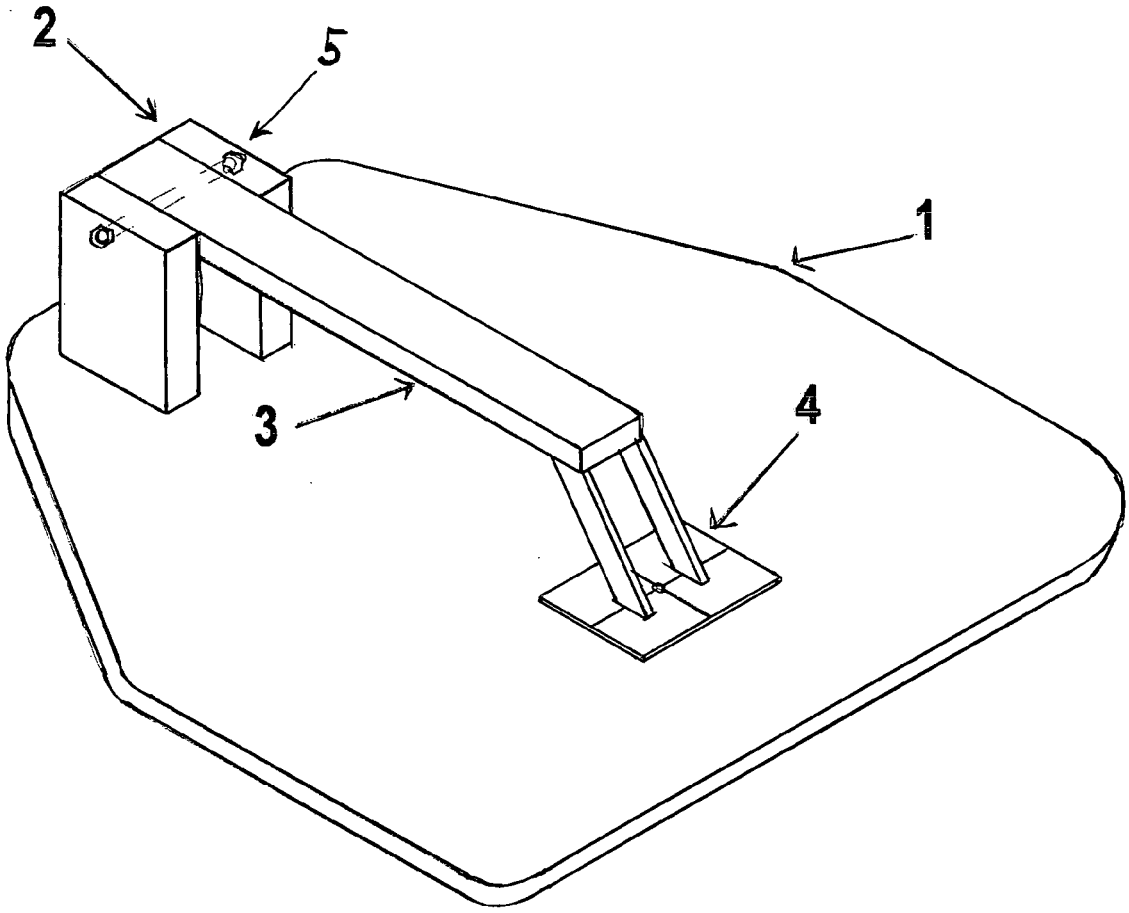
FIG. 3 shows an assembled anchoring and design placement device but without an anchoring device. Any of a large range of anchoring devices could be shown, but each one's position depends on the characteristics of the machine for which the device is configured, so none is shown in this drawing.

In FIG. 3 base 1, large enough to support the largest hoop for which the device is configured, supports a pair of stanchions 2 that firmly guide arm 3 and incorporate a pin or hinge. At the tip of arm 3 is a square or rectangle 4 of transparent material such as clear polycarbonate sized to fit inside the smallest hoop of the machine for which the device is configured. Crosshairs are inscribed, etched, or embossed in the transparent material. Friction is provided by threaded hinge pin 5 having adjustable nuts at both ends so that arm 3 can be left in any position.

The anchoring device, not shown in this figure, is affixed to base 1 in such a position that, when anchored, the center of the hoop (or family of hoops) is centered in the crosshairs.

OPERATION OF THE INVENTION

The operator defines the desired placement of the design on the correct side of the fabric or garment by means of a template or marks representing the center of the design and its desired angular orientation. Then the arm is raised and the female part of the selected hoop or, in the case of sticky stabilizer the completed hoop, is anchored by means of the anchoring device. The bracket side of the hoop is placed over the grooves/projections of the device so that the hoop is prevented from moving in the horizontal plane, and the fabric or garment is placed over the hoop. The height of the hinge pin above the base provides clearance under the arm for the bulk of the fabric or garment to occupy since the only area that will touch the stabilizer or be hooped is the wrong side directly under the design.

If a sticky stabilizer is not being used, the male part of the hoop is loosely placed in its approximate final position. If a hooped sticky stabilizer is being used, the operator avoids letting the fabric touch the stabilizer until manipulation is complete. In either case, the operator lowers the arm until it touches the fabric or garment, then moves the fabric or garment about until the desired orientation and location of the design with respect to the center of the hoop (positively represented by the crosshairs) is achieved, and completes the hooping process either by inserting the male portion of the hoop or, in the case of the sticky stabilizer, by pressing the fabric or garment down on the stabilizer.

The arm is raised and the hooped fabric or garment is then lifted straight up to clear the base of the device and is then inserted into the embroidery machine where it can be embroidered immediately, without movement or rotation, because the location and angular orientation are congruent with the defaults of the machine.

I claim:

1. A portable home embroidery hoop anchoring and design placement device consisting of:

A flat base with a column incorporating a pivot point and friction;

A hinged arm to which is attached a reticule (crosshairs);

A flat-bottomed hoop anchoring device which mimics the positional features of an embroidery machine mount and prevents movement of the hoop in the horizontal plane.

2. A portable home embroidery hoop anchoring and design placement device as described in claim 1 which can be configured for any home embroidery machine by changing the configuration of the anchoring device.

* * * * *